US005199653A

United States Patent [19]

Durrant et al.

[11] Patent Number: 5,199,653

[45] Date of Patent: Apr. 6, 1993

[54] DISCHARGE ASSEMBLY FOR CHIPPER/SHREDDER

[75] Inventors: John T. Durrant, Schagticoke; Michael J. Cowett, Watervliet; Kevin J. Connolly, Ballston Lake, all of N.Y.

[73] Assignee: Garden Way Incorporated, Troy, N.Y.

[21] Appl. No.: 789,053

[22] Filed: Nov. 7, 1991

Related U.S. Application Data

[63] Continuation of Ser. No. 554,121, Jul. 17, 1990, abandoned.

[51] Int. Cl.[5] ..... B02C 17/00

[52] U.S. Cl. ..... 241/73; 241/88.4; 241/89.1; 241/89.2; 241/89.3; 241/101.7; 241/285.2

[58] Field of Search ..... 241/73, 101.7, 285 A, 241/88.4, 89.1, 89.2, 89.3, 285.2

[56] References Cited

U.S. PATENT DOCUMENTS 2,360,892 10/1944 Rench et al. ..... 241/89.2
2,554,071 5/1951 Strawn ..... 241/285.2
3,220,658 11/1965 Shelton, Jr. ..... 241/285.2 X
4,252,280 2/1981 Rymer ..... 241/285.2 X
4,318,512 3/1982 Jacobson et al. ..... 241/255.2 X
4,836,457 6/1989 Greiner ..... 241/89.2 X

FOREIGN PATENT DOCUMENTS 535489 11/1955 Italy ..... 241/89.2

*Primary Examiner*—Mark Rosenbaum
*Assistant Examiner*—Frances Chin
*Attorney, Agent, or Firm*—Hayes & Reinsmith

[57] ABSTRACT

A discharge assembly controls the discharge of shredded and macerated materials from a chipper/shredder device. A discharge screen of the discharge assembly has a pair of fasteners on opposing ends of the discharge screen for removably mounting the screen on the chipper/shredder housing. An operator engageable handle is affixed to one end of the screen for handling the screen during installation and removal and a locator tab is affixed to the end of the screen opposing the handle and is received in aperture formed in the chipper/shredder housing for alignment of the discharge screen with the housing. A discharge tunnel is formed on a side of the housing and in communication with the discharge screen, and a service door is formed on a top side of a discharge tunnel allowing access to the tunnel for installation and removal of the discharge screen.

2 Claims, 4 Drawing Sheets

DISCHARGE ASSEMBLY FOR CHIPPER/SHREDDER

This is a continuation of application Ser. No. 07/554,121, filed on Jul. 17, 1990 which was abandoned by Formal Notice of Abandonment dated Dec. 13, 1991.

TECHNICAL FIELD

This invention relates to equipment for use with landscaping devices generally referred to as a chipper/shredder, and more particularly to a discharge assembly for controlling the discharge of shredded, macerated or otherwise reduced material from the chipper/shredder.

BACKGROUND OF THE INVENTION

Chipper/Shredders are well known garden and landscape accessories used to reduce a variety of items such as leaves, twigs, small branches, cardboard, etc., to small pieces. Typically, a chipper/shredder is provided with a hopper to receive materials to be shredded, macerated or otherwise reduced and a hopper throat to guide the materials towards high speed, rotating, pulverizing or macerating elements. For purposes for ease of understanding, the term Shredder and the term chipper/shredder are intended to include devices which pulverize and or macerate such garden waste and the elements, such as flails, which actually do the "work".

The pulverizing elements are typically located in a cavity of the Chipper/Shredder housing, the cavity having a discharge opening for discharging the shredded and macerated material. The discharge opening is covered by a discharge screen having numerous holes therein for discharging the shredded material. The size of the holes in the discharge screen determines the size of the material discharged from the Chipper/Shredder.

It is a primary object of the invention to provide a chipper/shredder discharge assembly having interchangeable discharge screens for varying the size of shredded and macerated materials discharged from a chipper/shredder;

It is another object of the invention to provide a chipper/shredder discharge assembly having a discharge screen with a built in structure for easy alignment of the screen with a housing of the chipper/shredder during installation of the discharge screen;

It is a further object of the invention to provide a chipper/shredder discharge assembly having a service door allowing easy access to the discharge screen of the assembly;

It is another object of the invention to provide a chipper/shredder discharge assembly which facilitates bagging of materials discharged from the chipper/shredder.

Other objects will be in part obvious and in part pointed out in more detail here and after.

A better understanding of the objects, advantages, features, properties and relations of the invention will be obtained from the following descriptions and accompanying drawings which set forth certain illustrative embodiments and are indicative of the various ways in which the properties of the invention are employed.

SUMMARY OF THE INVENTION

A chipper/shredder discharge assembly constructed according to the present invention comprises, in its preferred embodiment, a discharge element for covering a discharge opening in the housing of a chipper/shredder device, apertures formed in the discharge element for discharging materials shredded by pulverizing elements of the chipper/shredder, a pair of fasteners fixed to opposing ends of the discharge element for removably mounting the discharge element to the chipper/shredder housing, and an operator engageable handle fixed to one end of the discharge element for handling the discharge element during installation and removal.

In further accord with the invention a locator tab is fixed to an end of the discharge element opposing the handle and an aperture is formed in the housing of the chipper/shredder for receiving the locator tab for alignment of the discharge element with the housing during installation.

In still further accord with the invention, a discharge tunnel is fixed to a side of the chipper/shredder housing adjacent to the discharge opening and in communication with the discharge element for directing shredded materials to the side of the chipper/shredder, a service door is formed on a top side of the discharge tunnel allowing internal access to the tunnel for installation and removal of the discharge element, and the end of the tunnel is configured for interconnection with a discharge bag for collection of shredded materials.

DESCRIPTION OF A PREFERRED EMBODIMENT

The discharge assembly of the present invention is particularly well suited for use with a chipper/shredder device such as a Tomahawk Chipper/Shredder manufactured by Garden Way Incorporated, Troy, N.Y. The discharge assembly controls the discharge of shredded, macerated or otherwise reduced material from a discharge opening of the chipper/shredder device.

Figure 1:
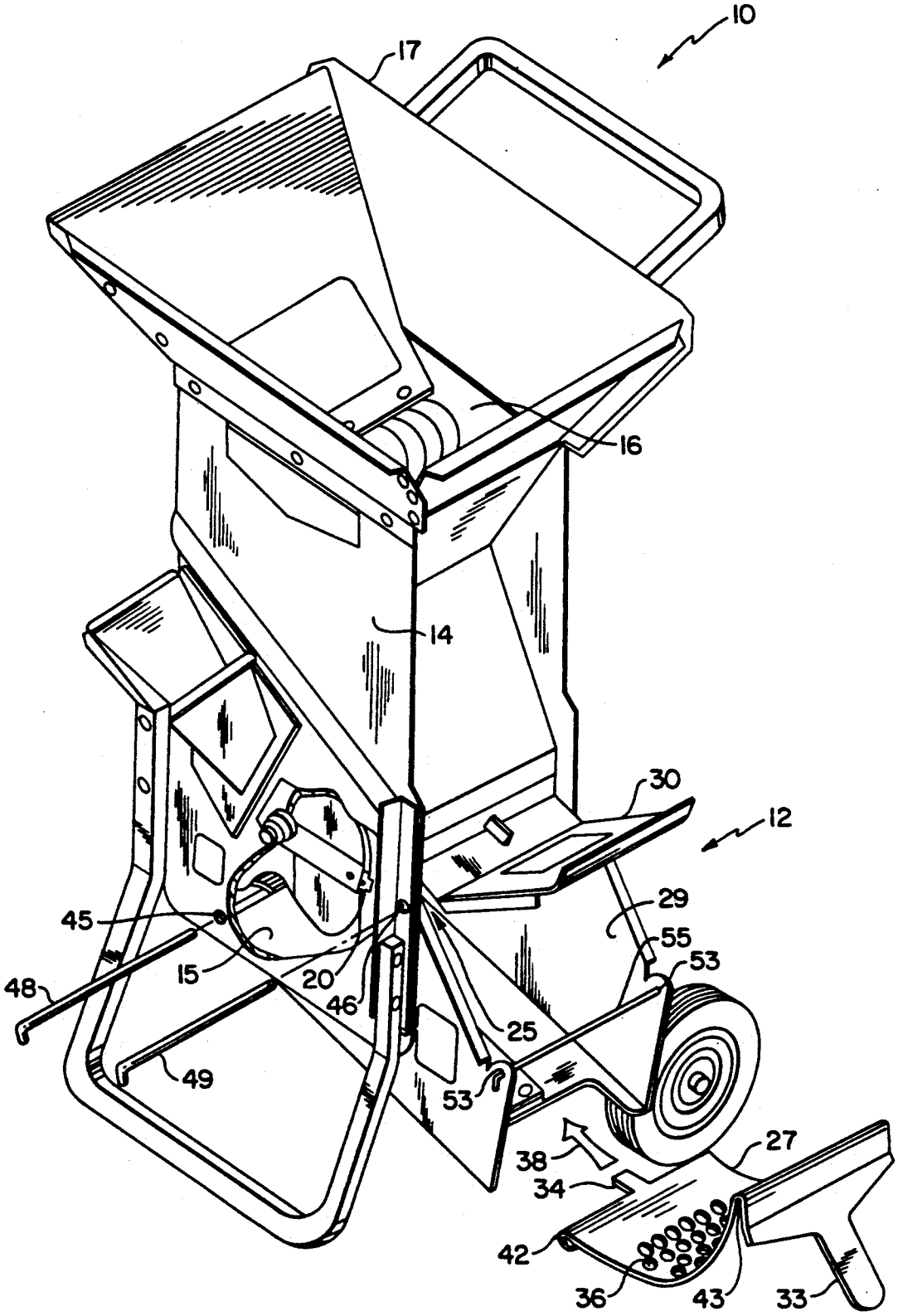
FIG. 1 is a perspective view, partially broken away, of a discharge assembly of the present invention installed on a Chipper/Shredder.

Referring particularly to FIG. 1, a chipper/shredder device 10 is shown having a discharge assembly 12 of the present invention. The chipper/shredder 10 includes a generally hollow housing 14 having a chipping/shredding cavity 15 in a lower portion thereof. A throat 16 in housing 14 connects a hopper 17 to cavity 15.

Chipping/Shredding elements 20 are rotatably disposed in cavity 15. The elements 20 function to shred material such as leaves, twigs, cardboard, small branches, or like material present within cavity 15. The hopper 17 and hopper throat 16 are designed to receive bulky materials such as leaves, twigs or cardboard into cavity 15.

Figure 4:
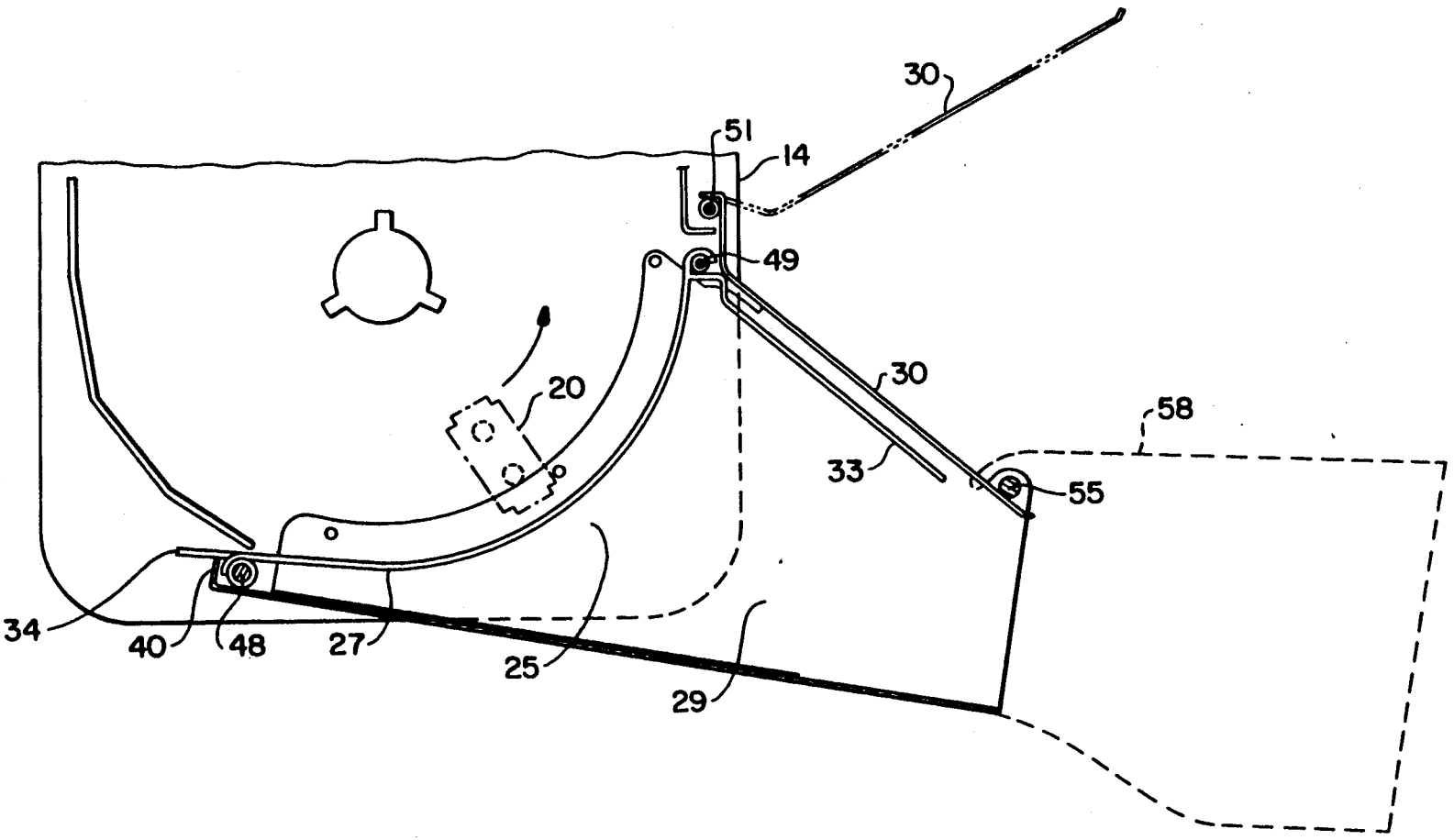
FIG. 4 is cross sectional view of the discharge assembly of FIG. 1, a collection bag shown in phantom.

Referring to FIGS. 1 and 4, discharge opening 25 is formed in the cavity to discharge shredded material. The discharge assembly 12 of the invention is formed on the housing 14 adjacent to and in communication with the discharge opening 25 to control the discharge of materials from the chipper/shredder cavity 15. More particularly, the discharge assembly comprises a discharge screen 27, a discharge tunnel 29, and a service door 30 formed on a top side of discharge tunnel 29.

Figure 2:
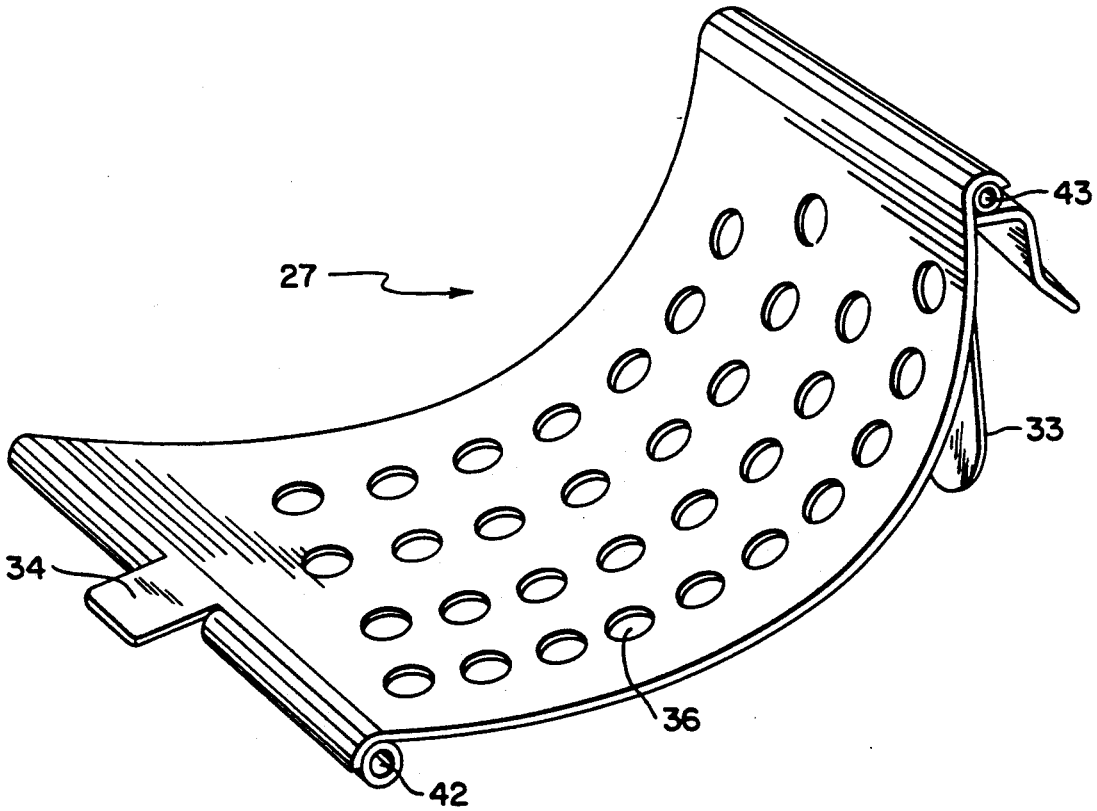
FIG. 2 is a perspective view of a discharge screen of the discharge assembly of FIG. 1.
Figure 3:
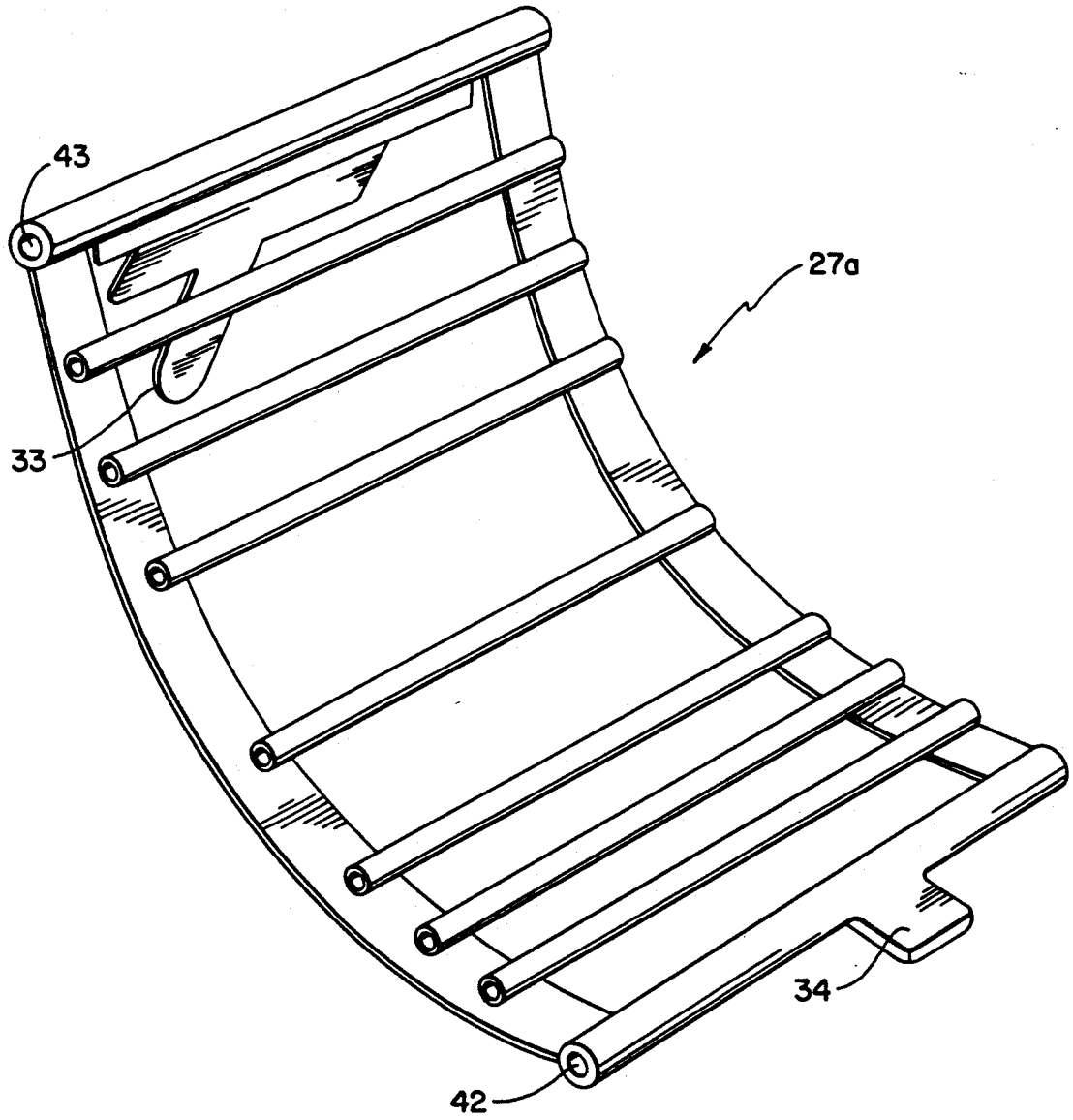
FIG. 3 is a perspective view of an alternative embodiment of the discharge screen of FIG. 2.

Referring to FIGS. 1, 2 and 4, discharge screen 27 is generally rectangular in shape, and is curved for maintaining a fixed distance between the rotating elements 20 and the screen 27. An operator engagable handle 33 is formed to an end of discharge screen 27 for easy handling during installation and removal. A locator tab 34 is formed on an end of the screen opposing the handle 33. Apertures 36 are formed in screen 27 for discharging material shredded by the elements 20. The size of the apertures 36 controls the size of the material discharged through the screen 27 after being shredded by the elements 20. For wet and bulky materials, a discharge screen having a grate design **27*a* (FIG. 3) is perferably used. The grate 27*a* utilizes the same general construction as the discharge screen 27** for easy installation and removal as described hereinafter.

During installation, the discharge screen 27 is held by the operator engageable handle 33 and is inserted into the discharge tunnel 29 in the direction shown by arrow 38 until the locator tab 34 engages with a correspondingly shaped aperture 40 in the housing 14. Engagement of locator tab 34 with housing aperture 40 indicates that the screen is properly positioned in the discharge opening 25. When tab 34 is completely inserted into aperture 40, a pair of passageways 42, 43 formed on the ends of the discharge screen 27 are aligned with pairs of aligned apertures 45, 46 in the housing 14. Rods 48, 49 are received through apertures 45, 46 and passageways 42, 43 for securly holding the discharge screen 27 in place over the discharge opening 25.

The discharge tunnel 29 is generally rectangular in shape and is fixed to a side of housing 14 adjacent to and in communication with discharge opening 25. The tunnel 29 is configured to discharge shredded material to the side of the chipper/shredder 10. Service door 30 is formed on a top side of discharge tunnel 29, and is attached to the housing 14 by hinge 51 allowing the service door 30 to pivot between and an open and closed position. A pair of aligned apertures 53 are formed in an end of the discharge tunnel 29 to receive a rod 55 to lock the service door 30 in the closed position. Collection bag 58 is removably attached to the discharge tunnel 29 for collecting shredded material. The collection bag 58 is manufactured of a suitable material such as nylon mesh which is strong and durable for receiving and retaining shredded materials while allowing the passage of air through the bag.

Although the invention has been illustated and described with respect to exemplary embodiments thereof, it should be understood by those skilled in the art that various other changes, ommissions and additions may be made therein and thereto without departing from the spirit and the scope of the invention.

We claim:

1. A discharge assembly for controlling the discharge of material from a discharge opening in a pulverizing cavity of a chipper/shredder device housing for garden waste and debris, the device having an entrance passageway for feeding garden waste and debris materials into the cavity and movable pulverizing elements in the cavity for chipping and/or shredding materials therein, comprising:

a discharge element covering the discharge opening having a generally rectangular shape and a plurality of fixed size apertures therein for discharging materials shredded by the pulverizing elements;

said discharge element having a mounting passageway at opposed ends thereof;

a removable fastening rod extending through each mounting passageway, said fastening rods cooperating between the passageway at opposite ends of said discharge element and said housing for rigidly supporting said element proximate the moveable pulverization elements during use while being removable from said discharge element and said housing to permit removal of said discharge element for clean-out and replacement purposes;

each said fastening rod being accessible from outside the cavity and the discharge assembly;

an operator engageable handle fixed to one end of said discharge element at the discharge opening end of the element for grasping said discharge element during installation and removal upon insertion and/or removal of each said fastening rod; and a locator tab fixed to the end of said discharge element opposite to said handle, said housing having an aperture adjacent to said discharge opening for receiving said locator tab, thereby to facilitate alignment of said passageways in said discharge element with said housing for insertion of said removeable fastening rods.

2. The discharge assembly of claim 1 further comprising a discharge tunnel extending from one side of said housing adjacent to the discharge opening and in communication with said discharge element, said tunnel having a service door on the top thereof hingedly attached to said housing to permit access to said tunnel for installation and removal of said discharge element.

* * * * *